United States Patent [19]

Chursinoff

[11] Patent Number: 4,856,496

[45] Date of Patent: Aug. 15, 1989

[54] REFLEX MASSAGER AND METHOD

[76] Inventor: Fred Chursinoff, Site 38, R.R. 1, C-1, Castlegar, B.C., Canada, V1N 3H7

[21] Appl. No.: 118,233

[22] Filed: Nov. 6, 1987

[51] Int. Cl.[4] ..... A61H 7/00

[52] U.S. Cl. ..... 128/52; 128/51; 128/25 B

[58] Field of Search ..... 128/51, 52, 46, 56, 128/25 B, 62 R, 67

[56] References Cited

U.S. PATENT DOCUMENTS

| | | | |
|---|---|---|---|
| 1,387,687 | 8/1921 | Chaussimand | 128/51 |
| 1,931,849 | 10/1933 | Matson | 128/56 |
| 2,004,671 | 6/1935 | Nelson | 128/25 B |
| 2,232,493 | 2/1941 | Stuckey et al. | 128/46 |
| 2,683,451 | 7/1954 | Clark | 128/51 |
| 2,765,786 | 10/1956 | Blong | 128/25 B |
| 3,035,570 | 5/1962 | Nelson . | |
| 3,276,060 | 10/1966 | Stokes, Jr. et al. . | |
| 3,626,933 | 12/1971 | Pollock | 128/52 |
| 3,939,825 | 2/1976 | Krummenacher | 128/25 B |
| 4,003,372 | 1/1977 | Willoby | 128/25 B |
| 4,165,737 | 8/1979 | Chapa | 128/24.3 |
| 4,205,663 | 6/1980 | Fujiwara | 128/57 |
| 4,523,580 | 6/1985 | Tureaud | 128/25 B |
| 4,599,997 | 7/1986 | Bucher | 128/25 B |
| 4,682,771 | 7/1987 | Jean | 128/25 B |

FOREIGN PATENT DOCUMENTS 3215226 10/1983 Fed. Rep. of Germany .

*Primary Examiner*—Edgar S. Burr
*Assistant Examiner*—Huong Q. Pham
*Attorney, Agent, or Firm*—Wells, St. John & Roberts

[57] ABSTRACT

A reflex massage device and process for pressing a plurality of individual pins having rounded reflex massage ends against a body surface, such as the plantar surface of a human foot or feet, to be massaged. The individual reflex massage pins are axially reciprocated by a cam with a sinuous surface through a prescribed pin stroke motion. As the cam is rotated, the pins reciprocate against the engaged surface to be massaged. A hold down mechanism selectively secures the foot or selected body surface axially against the pins. Adjustments are provided to adjustably bias the foot or selected body surface against the pins.

8 Claims, 2 Drawing Sheets

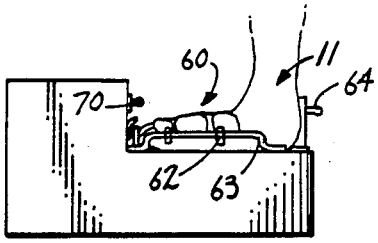
FIG 1
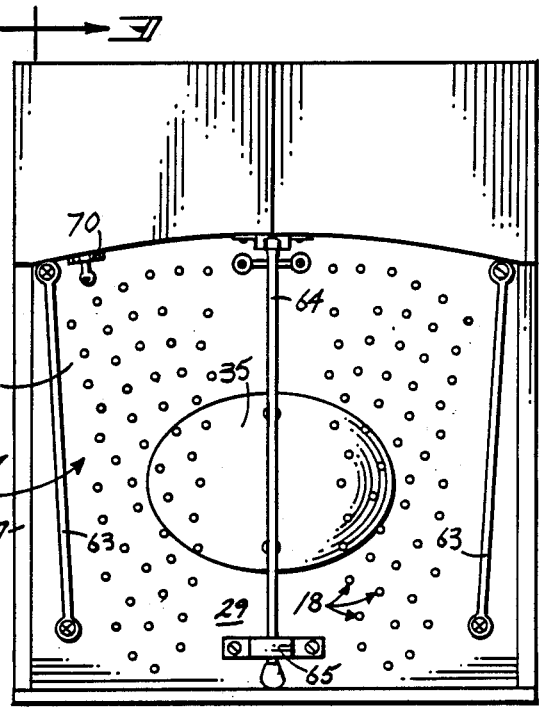
FIG 2
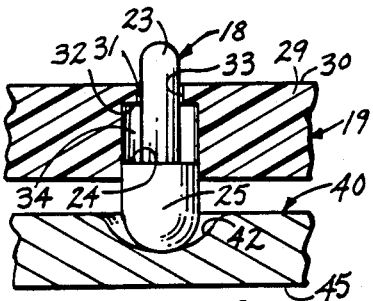
FIG 4
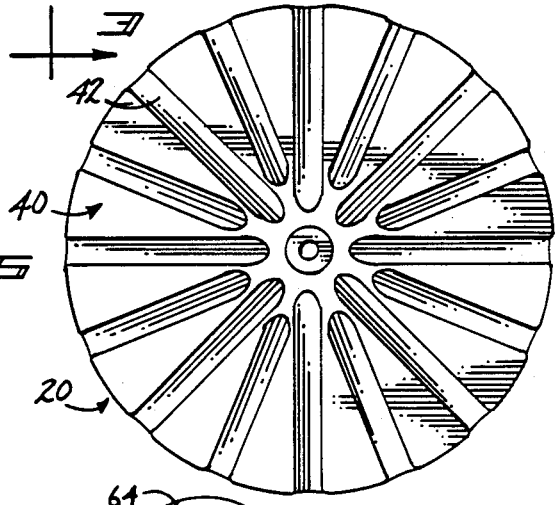
FIG 5
FIG 3
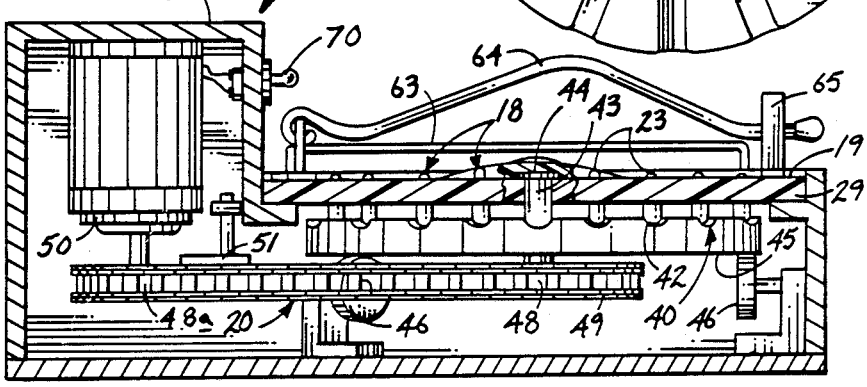

REFLEX MASSAGER AND METHOD

TECHNICAL FIELD

The present invention relates in general to apparatus and processes for performing reflex massage and more particularly to such apparatus and processes for performing reflex massage to the human feet.

BACKGROUND OF THE INVENTION

Foot reflex massage is a rapidly growing practice in which stimulus to various organs and bodily functions is achieved through compression massage of localized areas of the feet. The practitioner applies selective finger pressure to localized areas or zones of the foot that correlate with certain areas of the body. For example, for treatment of a sinus condition, pressure points along the balls of the toes are treated by direct application of pressure to those areas.

The time required for treatment is usually quite long if done properly and is physically demanding on the treating practitioner. Treatment is also time consuming and expensive for the patient. A need therefore exists for a mechanical system by which reflex treatment may be effected without requiring constant attention or labor by a practitioner and that may be made available to the patient without requiring presence of a practitioner.

A partial solution is recognized in U.S. Pat. No. 4,205,663 to Fujiwara. Fujiwara discloses a foot sole massaging device consisting of a frame with a number of parallel rollers, each having a set of radial projections. The rollers are arranged on the frame on parallel horizontal rotational axes. The projections rotate against the foot in response to back and forth movement of the foot or feet against the rollers. The patient thus propels the machine by his or her own foot movement. Treatment will continue only as long as the patient is able to shuffle his or her feet back and forth across the rollers. The user must also physically control downward pressure of his or her feet against the rollers. The projections and rollers in the Fujiwara device are arranged so a group of the projections are formed in a domed configuration to conform with the arched configuration of the user's feet. However, the arch or dome configuration is stationary with respect to the frame, while the user's foot must move along the frame in order to operate the machine. There is only one location along the back and forth travel of the foot across the projections at which the arched projections conform to the arch of the foot.

An apparatus somewhat similar to the Fujiwara device is shown in West German Patent No. 3,215,226. This device makes use of rollers that in one form include projections similar to those of the Fujiwara reference. This device also makes use of stationary upright brushes for rubbing along the length of the user's feet as they are moved by the user back and forth across the rollers.

U.S. Pat. No. 4,165,737 to Chapa discloses a powered foot massage device wherein rollers are moved along a working flight under the user's feet. The feet are held stationary while the rollers are moved lengthwise along a flat plane to massage the soles. Steam is generated by the unit and released under the feet being massaged by the moving rollers. Undoubtedly this device would produce a soothing effect. However, the rollers move lengthwise along the foot in a flat plane so there is little chance to gain the benefits of localized pressure applied for lasting periods of time and at specific reflex points along the feet.

U.S. Pat. No. 3,035,570 to Nelson discloses a foot massaging device that includes an oscillating flat platform and a rotating drum for massaging the feet. Again, while a soothing effect is most likely realized, no provisions are made for localized compression of reflex points for a therapeutic effect. U.S. Pat. Nos. 4,003,372 to Willoby and 3,276,060 to D. F. Stokes, Jr., et al., both disclose combined foot washing and massaging devices. Stokes provides a powered set of rotatable brushes and an upwardly directed water spray that act against the feet to clean and massage. Willoby discloses a mat that can be secured to the floor of a shower or tub. The mat includes flexible upstanding ribs. The user stands on the mat and shuffles his or her feet across the ribs for a massaging and cleansing effect.

There still remains a need for a device that will effectively stimulate reflex points of the feet by automatically pressing a number of individual reflex massage pins in the linear motion against local reflex areas of the feet and toes so that the entire arch configuration of the feet and toes are provided with a localized reflex massage.

BRIEF DESCRIPTION OF THE DRAWINGS

The preferred embodiment of the invention is illustrated in the accompanying drawings, in which:

FIG. 1 is a side elevation view of the present reflex massager exemplifying use of the device for reflex massage of a user's foot or feet;

FIG. 2 is an enlarged top plan view of the reflex massager with a hold down strap thereof removed for clarity;

FIG. 3 is an enlarged sectional view taken substantially along line 3—3 in FIG. 2;

FIG. 4 is an enlarged fragmented sectional view illustrating a single reflex massage pin and its relationship to a guide and drive means;

FIG. 6 is an enlarged fragmented pictorial view of a hold down device for selectively pressing the body surface being massaged against the reflex massage pins.

DETAILED DESCRIPTION OF THE PREFERRED EMBODIMENT

Figure 5:
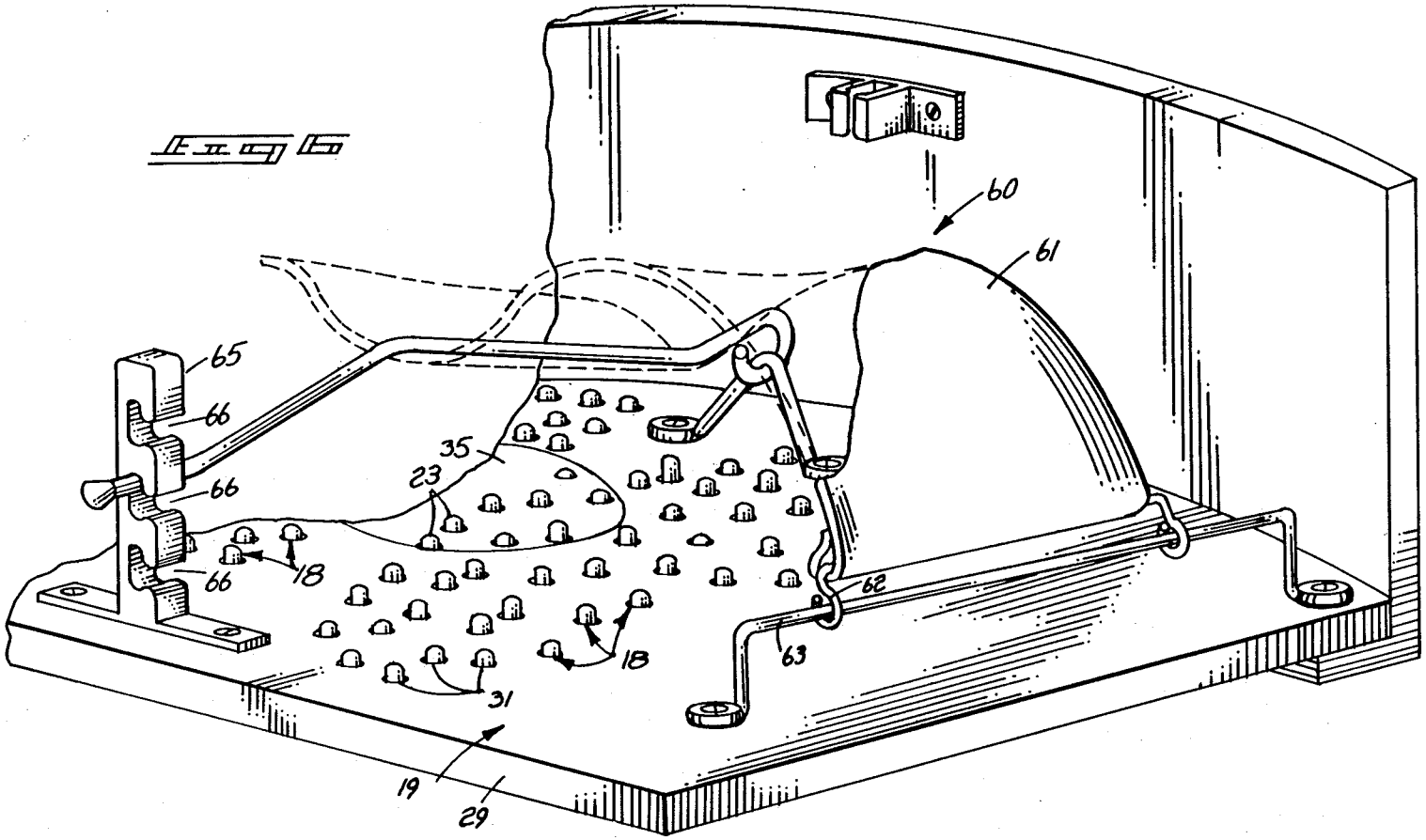
FIG. 5 is a detailed plan view of a plate cam for effecting linear movement of the individual reflex massage pins.

The following disclosure of the invention is submitted in compliance with the constitutional purpose of the Patent Laws "to promote the progress of science and useful arts" (Article 1, Section 8).

The present reflex massager is generally indicated by the reference numeral 10 in the accompanying drawings. The massager 10 is exemplified in the drawings and is described herein for particular use in providing reflex massage to the plantar surfaces of a user's foot 11 (FIG. 1). However, it should be understood that the present machine may be adapted for use in providing a reflex massage to other areas of the body. For example, it is entirely conceivable that the present machine could be adapted for reflex massage of the hands which also include nerve endings or zones that may be stimulated by reflex massage techniques afforded through the mechanism and process described below with minor modifications to accommodate the particular anatomy.

It is also conceivable that the present apparatus may be suitably modified for accommodating certain portions or all of the spinal area for reflex massage purposes. Any adaptation of the present machine, however, will include the underlying principles and general components described below and included within the scope of the following claims.

The present reflex massager includes a general framework 17. In the example shown, the frame 17 is simply a rigid box structure that is adapted for storage and transport. The present massager generally includes a plurality of reflex massage pins 18 and a guide means 19 on the frame 17 for orienting the pins for individual linear reciprocating movement along individual pin axes. A drive means 20 is utilized within the frame for producing the linear reciprocating motion of the pins through a prescribed stroke.

More specifically, the individual pins 18 are advantageously elongated and formed in the configuration detailed by FIG. 4. Each pin 18 may include the same general configuration as the pin shown in FIG. 4, but may vary in length according to the position of the pin within the frame. The pin lengths advantageously vary to accommodate the contours of the user's feet. The various length pins 18 may be arranged in a "foot print" pattern or patterns for both feet as shown. Pins in the area of the patient's heel may be substantially shorter than pins 18 situated within the arch area of the foot. Other pin lengths will vary between these two extremes as required so the contour defined by the upper rounded pin ends 23 of each pattern will conform elevationally to the general contours of the plantar surface of the human foot.

Description of the pin 18 shown in FIG. 4 will suffice for description of the remaining pins used in the present massager since variation need occur only along the axial pin length.

Each pin 18 is advantageously cylindrical at a first relatively small diameter leading from the upper rounded end 23 to a shoulder 24. An enlarged cylindrical configuration leads from the perimeter of the shoulder 24 to a lower rounded end 25. The length of the pin will typically vary along the reduced diameter area between the shoulder 24 and the rounded upper end 23.

It is preferred that the pins 18 be formed of a relatively low friction material, such as a form of conventionally available plastic that has a sufficient degree of axial rigidity to avoid undesired bending when in use.

Guide means 19 is preferably provided in the form of a plate 29 supported on frame 17. Plate 29 may include an upwardly facing support surface 30 that is capable of receiving and supporting the user's feet. However, the primary function of the plate is to receive and axially guide the pins 18 through their individual linear reciprocal strokes. To this end a number of apertures 31 (FIG. 4) are provided in the plate, equal in number to the number of pins 18. The apertures 31 are formed complementary to the pin configurations, each including a shoulder section 32 corresponding to a pin shoulder 24. Each aperture also includes a small bore 33 to slidably receive the upper rounded end 23 of a pin 18 while a larger concentric bore 34 slidably receives the enlarged cylindrical pin portion leading to the lower pin end 25.

As indicated above, the apertures are preferably oriented in footprint shaped patterns on the plate 19. The pins in each pattern are advantageously located at spaced intervals within the perimeter of each pattern to provide contact with local reflex points or zones along the plantar surfaces of the user's foot or feet. Spacing between the pins, their specific arrangement and numbers in each pattern may vary from the arrangement shown. In fact, the plate can be made to be removable to facilitate replacement or interchangeability with other plates having pin patterns (not shown) oriented to concentrate the reflex massaging action on specific areas of the feet as opposed to the overall patterns shown.

The apertures 31 are advantageously provided along substantially parallel axes. The pins 18 are therefore held in substantially parallel orientations. It is conceivable, however, that selected apertures and corresponding pins could be angularly oriented or tilted to facilitate application of compression massage along the areas of the footor feet being treated where such angular orientations are deemed preferable. Experimentation has indicated that a beneficial effect is realized simply by maintaining all pins 18 in substantially parallel, vertical orientations.

An arch plate 35 may be provided at the approximate center of plate 29. The arch plate 35 may be provided to conform with the user's arches and to enclose mechanism of the drive means described in greater detail below.

The drive means 20 may include a cam 40 operably engaging the pins 18 for causing linear reciprocation of the pins as directed by the guide means 19. The cam 40 is advantageously provided in the form of a substantially circular disk or plate. A sinuous cam surface 42 may be provided along a top surface of the cam 40 to slidably receive the enlarged lower pin ends 25. The pins will ride gravitationally along the sinuous cam surface 42 as the plate is rotated to produce linear reciprocating motion of the individual pins.

It is pointed out that the sinuous cam surface 42 can be arranged in configurations other than the substantially radial groove configuration shown in FIG. 5. The sinuous or undulating surfaces of the cam could also conceivably be arranged, for example in a substantially spiral configuration. Spiral grooves would enable an outward-to-inward massaging action that would take place by progressively undulating or reciprocating the pins 18 first at the outward surfaces of the feet. The spiral cam surface would then lift the successive pins in a "wave" action toward the inner perimeter of the feet.

The cam 40 is rotatably mounted to the frame 17 by a center shaft 43 (FIG. 3). The shaft 43 includes a headed end 44 journalled on the guide plate 29 within the confines of the arch plate 35. Shaft 43 holds the cam plate 40 for rotation about the center shaft axis.

The cam 40 includes a relatively flat bottom surface 45 opposite the sinuous cam surface 42. A number of support rollers 46 may be mounted to the frame under the bottom surface 45 to engage and provide low friction support to the cam by engagement against the bottom surface 45. Rollers 46 will hold the plate cam elevationally stationary while permitting relatively free rotation of the cam about its center shaft 43.

Rotation of the cam may be effected by the drive arrangement generally shown in FIG. 2. The driving arrangement shown may include a sprocket 48 mounted to the center shaft 43 and connected by an appropriate roller chain 49 to a drive sprocket **48*a* and an electrically operated conventional drive motor 50. An appropriate tensioning device 51** may also be provided to maintain proper tension along the chain and to facilitate removal and replacement of the chain when necessary.

It is evident that operation of the motor and drive sprocket 50 will cause corresponding motion of the chain 49 and sprocket 48. This rotational motion is transmitted directly to the cam 40 which rotates the sinuous cam surface in a horizontal plane about the central rotational axis. The rotating cam thus acts against the pins 18, causing corresponding linear reciprocation motion of the individual pins 18.

A hold down means 60 is shown generally in FIG. 1 and in more detail in FIG. 6. The hold down means 60 is provided generally to receive and press the adjacent body surface against the appropriate reflex massage pins. In the present example, the hold down means 60 is utilized to press the user's foot or feet downwardly against the upwardly projecting pin ends 23.

The hold down means 60 may include a strap 61 that is selectively placed over upper surfaces of the foot or feet and subsequently pressed downwardly to firmly press the feet against the reflex pins. The strap 61 may be formed of a resilient material such as rubber or latex to afford a yieldable biasing force. It is also conceivable that the yieldable feature desired may be obtained by securing a nonresilient strap to appropriate biasing springs (not shown) in order to produce a similar biasing effect.

The strap 61 is advantageously mounted by a mounting means including a pair of brackets 62, one at each end of the strap 61. Though only one bracket 62 is shown in the drawings, the other is substantially identical thereto. Description of the one will therefore suffice for description of both.

Hooked ends of the brackets are mounted to a pair of mounting rods 63. The rods 63 are mounted to the frame 17 on opposite sides of the aperture patterns formed in the guide plate 29. Rods 63 are elongated to facilitate adjustment of the brackets 62 and strap 61 to various positions overlying the reflex massage pins 18. The strap 61 can thus be positioned forwardly over pins situated toward the toe ends of the aperture patterns in order to press the toe or forward foot areas against the reciprocating pins is desired in that area of the foot or feet. Likewise, the rods enable the strap 61 and brackets 62 to be shifted rearwardly toward the heel of the foot patterns in order that the strap be positioned against the upper surfaces of the foot more directly adjacent to the heel for pressing those areas of the feet against the reciprocating pins.

The strap 61 may be selectively clamped over the user's feet by operation of a hold down rod 64 and an adjustment rack 65. The rod 64 and rack 65 along with the strap 61 function as pressure means on the frame for engaging and biasing the selected body surface axially against the pin reflex massage ends 22. The hold down rod 64 is pivoted at a forward end to the frame 17 and includes a free rearward end that can be selectively positioned in any one of a series of elevationally separated hooks 66 on the adjustment rack 65. The rod can be connected at an upper hook 66 of the rack to facilitate light downward pressure or at progressively lower elevations to selectively increase the pressure urging the engaged foot surface against the pins 18. The rod does this by drawing or clamping the strap downwardly across the engaged surfaces of the foot or feet.

Operation of the present invention and the present method for performing reflex massage may now be easily understood from an understanding of the present massager as technically described above.

Prior to operation, the user first connects the massager to a conventional source of electrical power. The user may then be seated or assume some other comfortable posture in order to place his or her feet at selected positions overlying the corresponding patterns of pins 18. According to the preference of the user, brackets 62 of the hold down strap may be hooked over the rods 63 to secure the strap over the user's feet. Alternatively, the user can simply rest the feet gravitationally against the pins, or may manually press his or her feet downwardly against the pins without using the strap.

The strap may then be positioned selectively over, say, the toe areas of the feet. This is done simply by sliding the strap and brackets 62 along mounting rods 63 toward the toe ends of the patterns in order to secure the adjacent areas of the foot and toes downwardly against the forward pins of the foot print shaped patterns below. After positioning, the strap may be secured by the hold down rod 64. Downward pressure may be selected by appropriately positioning the free rod end within a selected inverted hook 66 along the adjustment rack 65. Increasing downward pressure may be applied through the strap by appropriately securing the hold down rod end within the hook portion 66 spaced closest to the plate 29 (see FIG. 6).

The motor 50 may now be activated to begin the reflex massage action. This may be done using an appropriate conventional switching device 70, electrically connected with the motor 50. Rotation of the motor sprocket **48*a* is transmitted through the chain 49 to the sprocket 48. This sprocket 48 correspondingly rotates the cam 40. The rotating cam moves the sinuous cam surface 42 in a circular path under the lower pin ends 25. The moving cam surface thus causes the pins to move through strokes defined by the amplitude of the sinuous cam surface in linear, up and down motions. The upward, reflex massage ends 23** of the pins thus reciprocate up and downwardly against adjacent surface areas of the foot.

The pins reciprocating against the relatively stationary feet provide a massaging, but perhaps more importantly, reflex massage action through which benefit may be gained without requiring extended hand manipulation of the concerned reflex points or zones. The user can move his or her feet around in order to "pin point" particular areas needing stimulation. The user can also adjust the amount of downward pressure applied and, hence, the amount of the linear force applied through the pins to the contacted surfaces. The feet may remain in stationary selected positions over the pins so the arch configuration produced by the varied length pins 18 may conform intimately to the plantar surface of the feet throughout the treatment period and so long as the feet remain stationary over the pins.

The treatment may continue as long as the user desires, since there is no physical demand placed on the user to operate the mechanism. When it becomes desirable to terminate the treatment, the user may simply switch the motor "off" and remove his or her feet from the pins 18.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A reflex massager, comprising:

a frame;

a plurality of reflex massage pins, each having an upward massage end and a lower end;

hold dow means for releasably receiving a surface to be massaged and for selectively pressing the surface against the upward massage ends of the reflex massage pins;

guide means on the frame orienting the pins for individual linear reciprocating movement and for organizing the pins in a prescribed pattern; and drive means operatively connected to the reflex massage pins for reciprocating individual reflex massage pins through a prescribed stroke, said drive means including a plate having a plurality of substantially radial grooves on one side thereof, the lower end of each of said pins resting upon the same side of said plate as said radial grooves, means to rotate said plate to cause said grooved surface to forcibly move said pins upwardly and to subsequently allow said pins to move downwardly in response to gravity to complete said prescribed stroke in response to rotation of said plate.

2. The reflex massager of claim 1 wherein the pins vary in length and are arranged by the guide means to substantially conform to the contours of the plantar arch surface of the human foot.

3. The reflex massager of claim 1 wherein the guide means is comprised of an apertured plate, the apparatus being arranged in a prescribed footprint pattern and shaped to slidably receive the pins.

4. The reflex massager of claim 1 wherein said reflex massage pins are moved along parallel and upright axes.

5. The reflex massager of claim 1 wherein the guide means is an apertured plate with the apertures thereof being substantially vertical and slidably receiving the reflex massage pins for substantially free vertical movement therein.

6. The reflex massager of claim 1 wherein there are two sets of reflex massage pins, oriented by the guide means into two human footprint shaped patterns.

7. The reflex massager of claim 6 wherein each pin moves along an upright axis and the plate rotates about an axis that is parallel with the movement of the reflex massage pins.

8. The foot reflex massager of claim 1 further comprising mounting means for the hold down means for adjustably positioning the hold down means at selected positions overlying the reflex massage pins.

* * * * *